US006056606A

United States Patent [19]

Daoud

[11] Patent Number: 6,056,606

[45] Date of Patent: May 2, 2000

[54] BASE FOR ELECTRICAL COMPONENTS WITH POTTED TERMINALS

[75] Inventor: Bassel H. Daoud, Parsippany, N.J.

[73] Assignee: Lucent Technologies, Inc., Murray Hill, N.J.

[21] Appl. No.: 09/141,115

[22] Filed: Aug. 27, 1998

[51] Int. Cl.[7] ..... H01R 9/24

[52] U.S. Cl. ..... 439/888; 439/936; 174/77 R

[58] Field of Search ..... 439/888, 936, 439/521; 174/76, 77 R

[56] References Cited

U.S. PATENT DOCUMENTS 4,913,659 4/1990 Doyle ..... 439/395

5,139,440 8/1992 Volk et al. ..... 439/413

5,518,427 5/1996 Kan et al. ..... 439/936

5,637,007 6/1997 Suzuki et al. ..... 439/936

*Primary Examiner*—Renee S. Luebke

*Assistant Examiner*—T. C. Patel

*Attorney, Agent, or Firm*—Baker & McKenzie

[57] ABSTRACT

A base for mounting electrical components having terminals which are potted. The base uses a substantially smaller amount of potting material than conventional bases. Furthermore, the base provides a larger contact surface area for the deposited potting material, allowing the potting material to cure more quickly. In addition, trough space between the components on the upper surface of the base is increased substantially.

6 Claims, 2 Drawing Sheets

BASE FOR ELECTRICAL COMPONENTS WITH POTTED TERMINALS

FIELD OF THE INVENTION

The present invention relates to wiring devices, in particular to a base for holding electrical components having connection terminals that are potted.

BACKGROUND INFORMATION

In outdoor applications, it is known to pot the terminals of electrical components for protection against the elements. A common type of terminal is a wire-wrap terminal in which wire is wrapped around a pin-like terminal tail. The wire-wrap tail section of a terminal must be long enough to wrap at least one wire around the terminal. Where double wire-wraps are used, the tail section must provide adequate length for wrapping two wires around the terminal. The potting material should fully cover the wrapped terminal tails. As such, more potting material is required to cover longer, double wire-wrap terminals.

FIG. 1A shows a base 10 which carries one or more components 20 having wire-wrap terminal tails 21. The components 20 are seated in receptacles 11 on the upper surface of the base 10. A trough space 12 is formed between adjacent receptacles 11 (or rows of receptacles). The space 12 is typically used for running wires therethrough. The terminal tails 21 of the components 20 protrude through openings 14 in the base 10 into a bottom cavity 13 of the base 10.

As shown in FIG. 1B, potting material 15 is deposited in the cavity 13, completely covering the terminal tails 21. Naturally, the potting material 15 would be deposited after the terminal tails 21 have been wired. (The wires have been omitted from the drawings for clarity.)

The known arrangement of FIGS. 1A and 1B suffers from several drawbacks. First, a large amount of potting material is required to fill the cavity and cover the terminal tails 21.

Furthermore, the deposited potting material 15 can take a significant amount of time to cure. The curing time of any potting material increases with the thickness of the potting material used. The potting material will tend to cure from the outside in; i.e, the exposed surfaces of the potting material will cure before the interior of the potting material.

The aforementioned problems are particularly true in applications using extra long terminal tails 21, such as double wire-wrap terminals.

SUMMARY OF THE INVENTION

The present invention is directed to a base for electrical components which overcomes the problems of known devices and provides further advantages.

The present invention provides a base in which recesses, such as channels, are provided around the terminal tails. The potting material is deposited in the recesses.

The recesses are preferably just wide enough to allow the insertion of wire-wrap tools. The recesses are deep enough to allow coverage of the terminal tails with the potting material.

The base of the present invention allows the potting of terminal tails with significantly less potting material.

Furthermore, the base of the present invention allows the deposited potting material to cure more quickly.

The base of the present invention also provides deeper troughs between the components, thereby providing more room for running wires on the top side of the base.

DETAILED DESCRIPTION

Figure 2A:
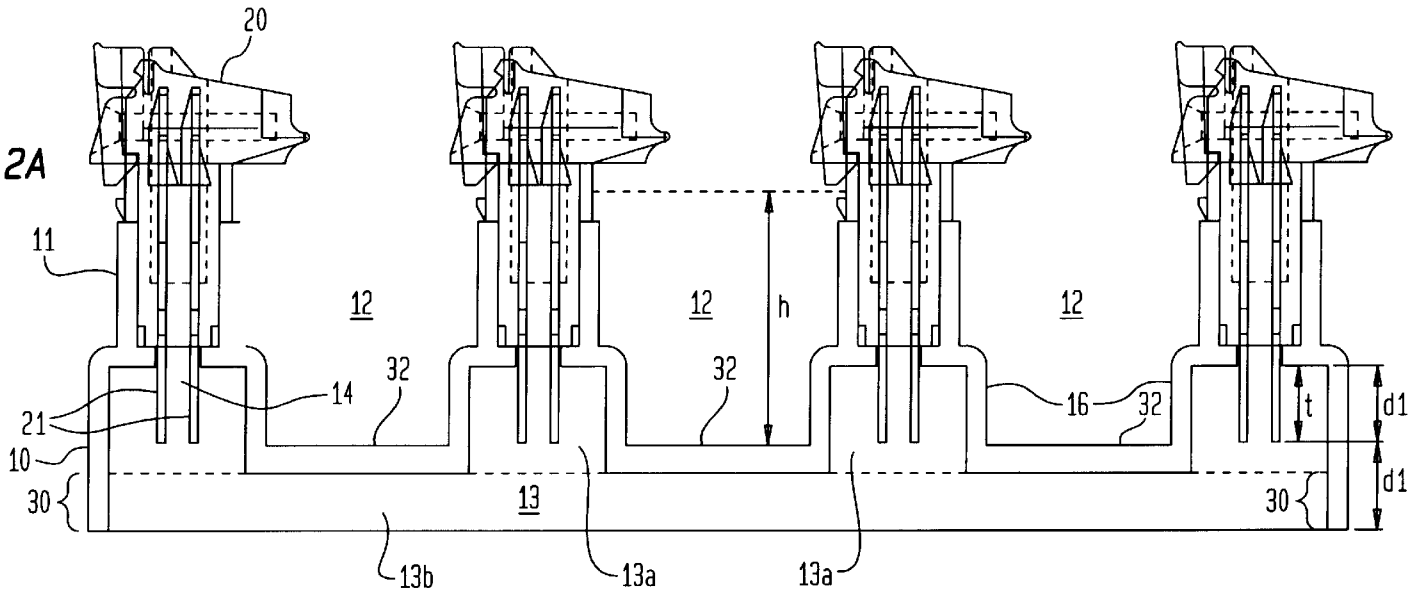
FIG. 2A is a cross-sectional view of a base in accordance with the present invention.

FIG. 2A is a cross-sectional view of an exemplary embodiment of a base 10 in accordance with the present invention. The base 10 carries one or more components 20, each having one or more wire-wrap terminal tails 21. The components 20 are seated in receptacles 11 on the upper surface of the base 10. In the exemplary embodiments shown, the components 20 are connectors, although the present invention can be used with any components having terminals that are to be potted. The receptacles 11 are adapted to receive the components 20 therein.

The upper surface of the base 10 includes one or more raised portions 16. The receptacles 11 are located on the raised portions 16. With the components 20 seated in the receptacles 11, the terminal tails 21 of the components 20 protrude through openings 14 in the raised portions 16 of the base 10. The tails 21 protrude into cavity portions 13*a* of a bottom cavity 13. Adjacent raised portions 16 are connected by a connecting member 32. The bottom cavity 13 includes a bottom or flat cavity portion 13*b* beneath the cavity portions 13*a*. The cavity portions 13*a* are formed by the bottom surfaces of the raised portions 16 of the base 10. The cavity portions 13*a* appear as recesses in the bottom of the base 10. The bottom cavity portion 13*b* is formed by a lower member 30 attached to the raised portions 16 and one or more of the connecting members 32.

Each raised portion 16 can be formed as a pedestal upon which one component 20 is placed or as a ridge upon which a row of several components 20 is placed. Likewise, each cavity portion 13*a* beneath each raised portion can be formed as an individual recess into which the terminal tails 21 of one component protrude or as a channel into which the terminal tails 21 of several components 20 protrude.

The cavity portions 13*a* should preferably be as narrow as possible although wide enough to allow the insertion and operation of a wire-wrap tool (or any such tool for connecting wires to the terminals) on the terminal tails 21.

The cavity portions 13*a* have a depth d1 which is preferably at least as long as the protrusion t of the terminal tails 21 into the cavity portions 13*a*. The flat cavity portion 13*b* beneath the cavity portions 13*a* has a depth d2.

A trough space 12 is formed between adjacent features 11 and raised portions 16 on the upper surface of the base 10. The height h of the trough spaces 12 is greater than that of the base of FIGS. 1A and 1B as it includes the height of the raised portions 16. As such, more room is provided in the troughs 12 for such purposes as running wires.

Figure 2B:
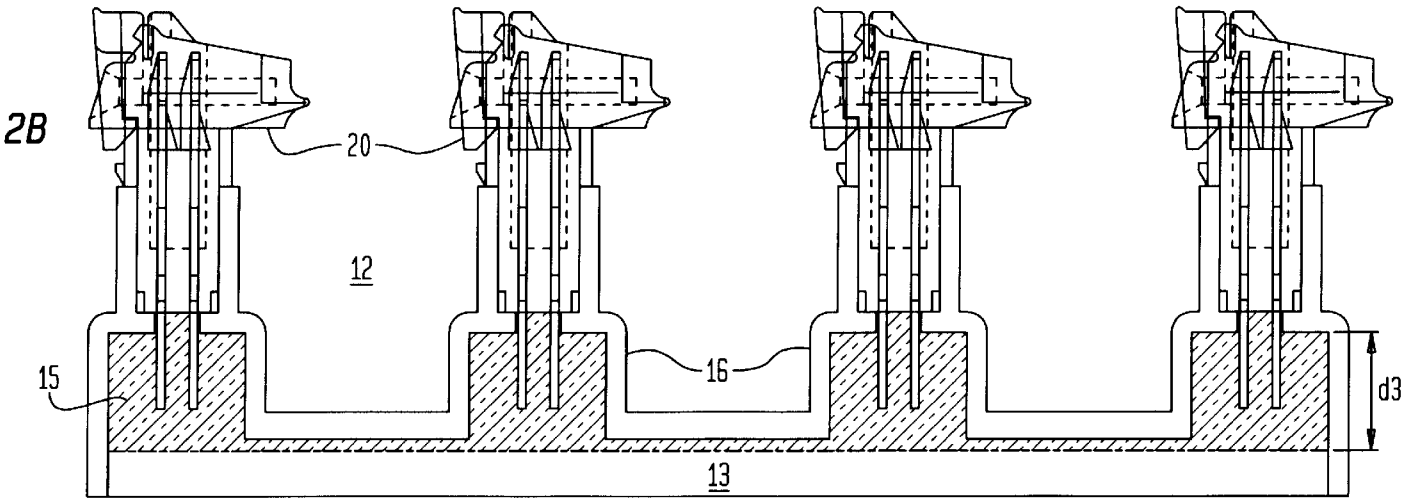
FIG. 2B is a cross-sectional view of the base of FIG. 2A with potting material deposited.

FIG. 2B shows the base of FIG. 2A with potting material 15 applied to the bottom thereof. The potting material 15 preferably fills the cavity portions 13*a*, but need not to, so long as it covers the terminal tails. The potting material 15 can also fill some or all of the cavity portion 13*b*. In other words, the depth d3 of the potting material 15, as measured from the tops of the cavity portions 13*a*, can be:

$$d1+d2 \geqq d3 \geqq t.$$

If the protrusion t of the terminal tails 21 into the cavity 13 exceeds the depth d1 of the cavity portions 13*a,* then the depth d3 of the potting material will exceed the depth d1 of the cavity portions 13*a.*

Nonetheless, even if the protrusion t of the terminal tails 21 into the cavity portions 13*a* is less than the depth d1 of the cavity portions 13*a* (as shown in FIGS. 2A and 2B), it may be desirable to apply the potting material 15 to a depth d3 which exceeds the depth d1 of the cavity portions 13*a.* In this case (which is shown in FIG. 2B), a layer of potting material of depth d3–d1 is deposited underneath the cavity portions 13*a* (i.e., in the cavity portion 13*b*). Upon curing, this layer adds additional structural rigidity to the completed assembly which may be required or desirable in certain applications.

Figure 1A:
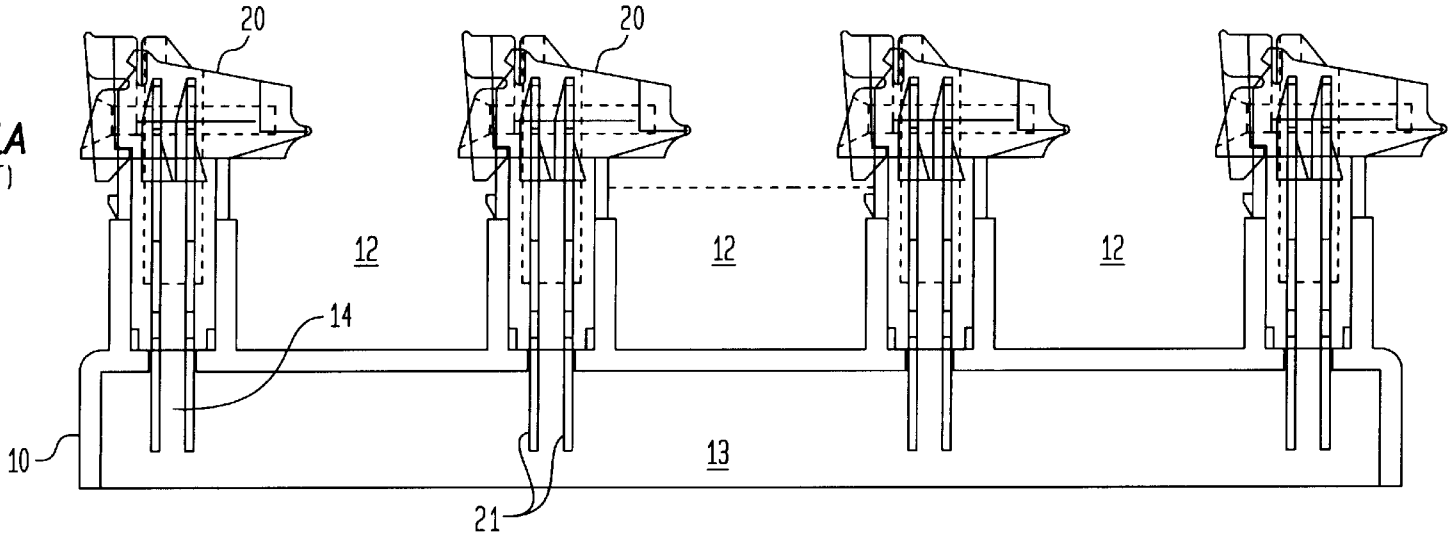
FIG. 1A (PRIOR ART)
FIG. 1A is a cross-sectional view of a known base design.
Figure 1B:
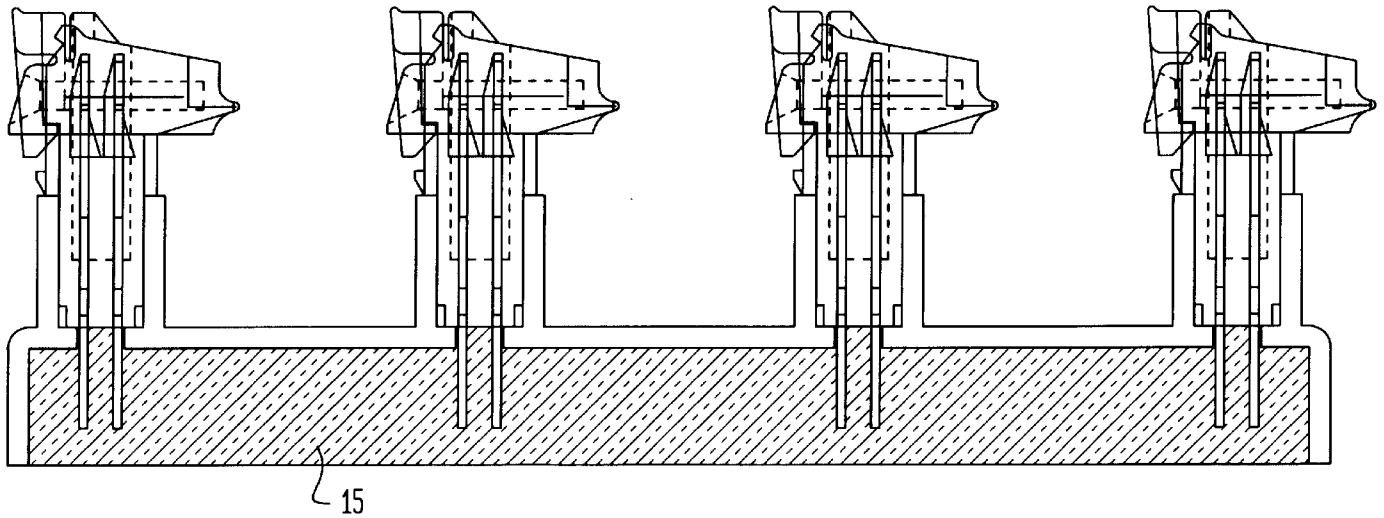
FIG. 1B (PRIOR ART)
FIG. 1B is a cross-sectional view of the base of FIG. 1A with potting material deposited.

The base 10 of the present invention uses substantially less potting material than that of FIGS. 1A and 1B. Furthermore, the base 10 of the present invention allows the deposited potting material 15 to cure more quickly than does the base of FIGS. 1A and 1B because it provides a substantially larger contact surface area for a substantially smaller volume of potting material.

The base 10 of the present invention can be comprised of plastic or any such suitable material.

It also bears noting that the base of the present invention is not limited to use with components having wire-wrap terminal tails and is applicable to a variety of terminals that are to be potted.

What is claimed is:

1. A base for holding electrical components, each one of the electrical components having at least one terminal, the base comprising:

a plurality of spaced apart raised members having openings for receiving at least one terminal of an electrical component, each of the raised members forming a cavity portion;

at least one connecting member connecting adjacent raised members of the plurality of raised members; and a lower member attached to each of the plurality of raised members and the at least one connection member, the lower member and the at least one connecting member forming a bottom cavity, wherein the bottom cavity communicates with each of the plurality of cavity portions of the respective raised members.

2. The base of claim 1, wherein the lower member is integrally attached to each of the plurality of raised members and the at least one connecting member.

3. The base of claim 1, wherein the plurality of raised members includes a plurality of receptacles for receiving a plurality of electrical components.

4. The base of claim 1, wherein the at least one terminal of an electrical component includes a wire-wrap terminal tail.

5. The base of claim 1, further including a potting material, wherein the potting material is applied to at least the cavity portion to cover the at least one terminal of an electrical component.

6. The base of claim 5, wherein a depth of the potting material exceeds a depth of the cavity portion.

* * * * *